US009885139B1

(12) United States Patent
Leibman et al.

(10) Patent No.: US 9,885,139 B1
(45) Date of Patent: Feb. 6, 2018

(54) ASPIRATOR WITH OFFSET OUTLET

(71) Applicant: Haier US Appliance Solutions, Inc., Wilmington, DE (US)

(72) Inventors: Alexander B. Leibman, Prospect, KY (US); Christopher Edward O'Malley, Louisville, KY (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 0 days.

(21) Appl. No.: 15/267,279

(22) Filed: Sep. 16, 2016

(51) Int. Cl.

| | |
|---|---|
| ***D06F 39/08*** | (2006.01) |
| ***D06F 39/02*** | (2006.01) |
| ***D06F 37/26*** | (2006.01) |
| ***D06F 37/12*** | (2006.01) |
| ***D06F 39/00*** | (2006.01) |
| ***D06F 33/02*** | (2006.01) |

(52) U.S. Cl.
CPC ..... *D06F 39/088* (2013.01); *D06F 33/02* (2013.01); *D06F 37/12* (2013.01); *D06F 37/26* (2013.01); *D06F 39/005* (2013.01); *D06F 39/022* (2013.01)

(58) Field of Classification Search
None
See application file for complete search history.

(56) References Cited

U.S. PATENT DOCUMENTS

| | | | | |
|---|---|---|---|---|
| 8,850,856 | B2 | 10/2014 | Leibman et al. | |
| 9,051,676 | B2 | 6/2015 | Leibman et al. | |
| 2014/0352364 | A1 | 12/2014 | Martinez Villarreal | |
| 2014/0373284 | A1* | 12/2014 | Leibman | D06F 39/028 8/137 |
| 2014/4373284 | | 12/2014 | Leibman et al. | |

FOREIGN PATENT DOCUMENTS

| | | |
|---|---|---|
| FR | 2410697 | * 12/1997 |

* cited by examiner

*Primary Examiner* — Michael Barr
*Assistant Examiner* — Jason Riggleman
(74) *Attorney, Agent, or Firm* — Dority & Manning, P.A.

(57) ABSTRACT

A washing machine appliance includes a reservoir and a dispensing assembly for drawing fluid additives from the reservoir into the wash basket of the washing machine appliance. The dispensing assembly includes an aspirator comprising a water inlet, an additive inlet, and an outlet. The outlet of the aspirator is positioned above the maximum fill level of a fluid storage volume of the reservoir.

13 Claims, 11 Drawing Sheets

ASPIRATOR WITH OFFSET OUTLET

FIELD OF THE INVENTION

The present subject matter relates generally to fluid additive reservoirs and dispensers for appliances, e.g., washing machine appliances.

BACKGROUND OF THE INVENTION

Washing machine appliances can use a variety of fluid additives (in addition to water) to assist with washing and rinsing a load of articles. For example, detergents and/or stain removers may be added during wash and prewash cycles of washing machine appliances. As another example, fabric softeners may be added during rinse cycles of washing machine appliances.

Fluid additives are preferably introduced at an appropriate time during the operation of washing machine appliance and in a proper volume. By way of example, adding insufficient volumes of either the detergent or the fabric softener to the laundry load can negatively affect washing machine appliance operations by diminishing efficacy of a cleaning operation. Similarly, adding excessive volumes of either the detergent or the fabric softener can also negatively affect washing machine appliance operations by diminishing efficacy of a cleaning operation.

For instance, when too much detergent is added during a wash cycle, detergent can remain in articles after a rinse cycle because the rinse cycle may not be able to remove all of the detergent from the articles. Unremoved detergent can cause graying within such articles as the detergent builds up over time, can contribute to a roughness feeling of such articles, and can trigger skin allergies. The unremoved detergent can also negatively affect the efficacy of fabric softener during the rinse cycle. Further, unremoved detergent can also cause excess suds that can damage the washing machine and/or decrease a spin speed of the washing machine appliance's drum thereby causing articles therein to retain excessive liquids.

As a convenience to the consumer, certain washing machine appliances include systems for automatically dispensing detergent and/or fabric softener. Such systems can store one or more fluid additives in a bulk tank and dispense such fluid additives during operation of the washing machine appliances. Some such systems include a pump for drawings the additive(s) from the bulk tank and dispensing them into a wash tub and/or wash basket of the washing machine appliance. However, it can be difficult to precisely control the flow of additive(s) from the bulk tank when using such pumps. For example, gravitational head may cause flow from the bulk tank to continue even after the motive fluid has stopped flowing through the pump.

Accordingly, a washing machine appliance with features for improved control over the amount and duration of additive flow from the bulk tank would be useful.

BRIEF DESCRIPTION OF THE INVENTION

The present subject matter provides a washing machine appliance. The washing machine appliance includes a bulk dispense system including an aspirator or a Venturi pump. Additional aspects and advantages of the invention will be set forth in part in the following description, or may be apparent from the description, or may be learned through practice of the invention.

In a first exemplary embodiment, a washing machine appliance is provided. The washing machine appliance includes a cabinet having a top panel, the top panel defining a vertical direction, a lateral direction and a transverse direction that are mutually perpendicular to one another, the top panel defining an opening. The washing machine appliance also includes a basket rotatably mounted within the cabinet below the top panel, a reservoir positioned below the top panel, the reservoir comprising an inlet, an outlet, and an additive storage volume, the additive storage volume positioned between the inlet and the outlet of the reservoir, the inlet of the reservoir positioned at the opening of the top panel, and a dispensing assembly mounted to the top panel, the dispensing assembly comprising a supply conduit and an aspirator, the supply conduit extending between the reservoir and the aspirator, the aspirator having a water inlet, an additive inlet, and an outlet, the outlet of the aspirator positioned above the fluid storage volume of the reservoir.

In a second exemplary embodiment, an aspirator for a washing machine appliance is provided. The aspirator defining a vertical direction, a lateral direction and a transverse direction that are mutually perpendicular to one another. The aspirator includes a water inlet conduit, an additive inlet conduit, and an outlet conduit, wherein the outlet conduit is generally orthogonal to the water inlet conduit in a plane defined by the lateral and transverse directions, and the outlet conduit is offset from the water inlet conduit along the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
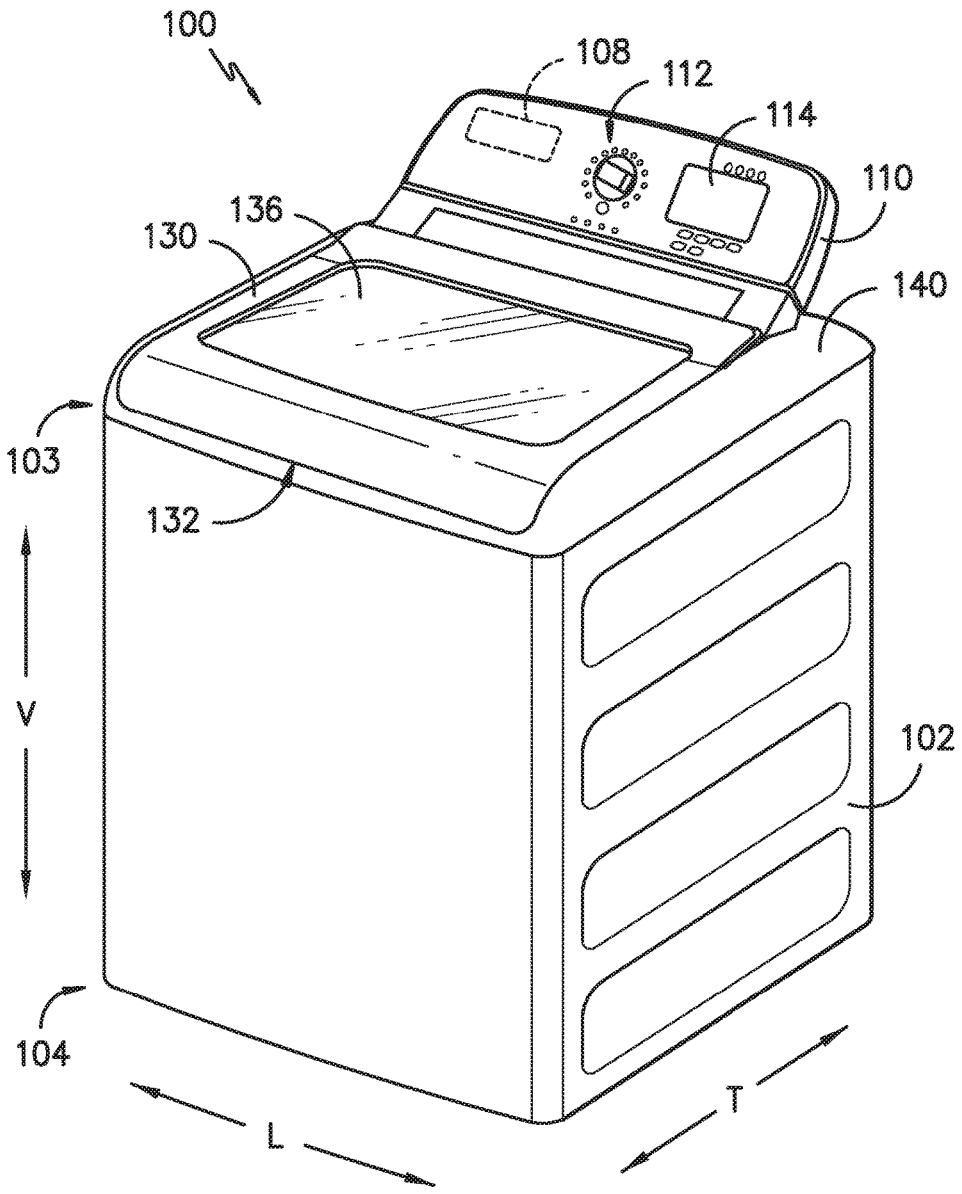
FIG. 1 provides a perspective view of an exemplary appliance, which is illustrated as a washing machine appliance with a door of the washing machine appliance shown in a closed position, that may incorporate various embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
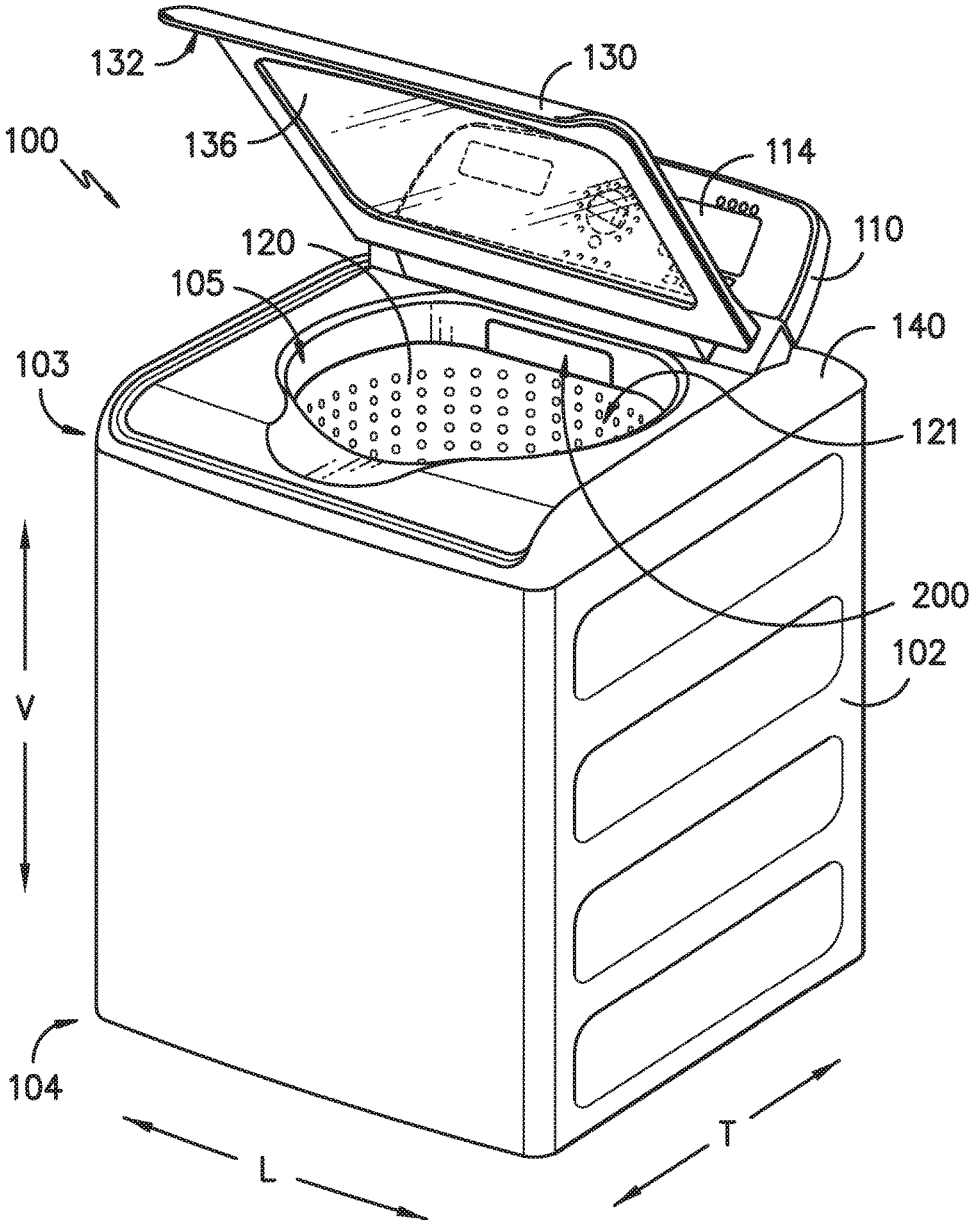
FIG. 2 provides a perspective view of the exemplary washing machine appliance of FIG. 1 with a door of the washing machine appliance shown in an open position.
Figure 4:
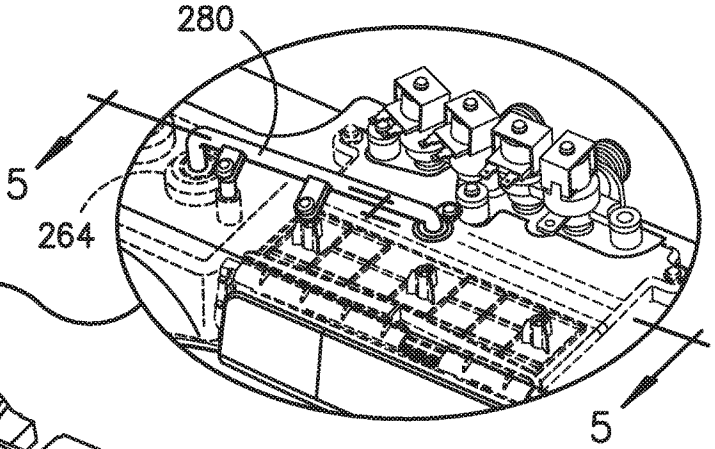
FIG. 4 provides an enlarged perspective view of a portion of the exemplary top panel of FIG. 3.

FIGS. 1 and 2 illustrate an exemplary embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, which are mutually perpendicular with one another, such that an orthogonal coordinate system is generally defined.

While described in the context of a specific embodiment of vertical axis washing machine appliance 100, it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along the vertical direction V. A wash tub (not shown) is disposed within cabinet 102, and a wash basket 120 is rotatably mounted within tub of cabinet 102. A motor (not shown) is in mechanical communication with wash basket 120 to selectively rotate wash basket 120 (e.g., during an agitation or a rinse cycle of washing machine appliance 100). Wash basket 120 defines a wash chamber 121 that is configured for receipt of articles for washing. The wash tub holds wash and rinse fluids for agitation in wash basket 120. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140, e.g., at top portion 103 of cabinet 102. Top panel 140 defines an aperture 105 that permits user access to wash basket 120. Door 130, rotatably mounted to top panel 140, permits selective access to aperture 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

Figure 3:
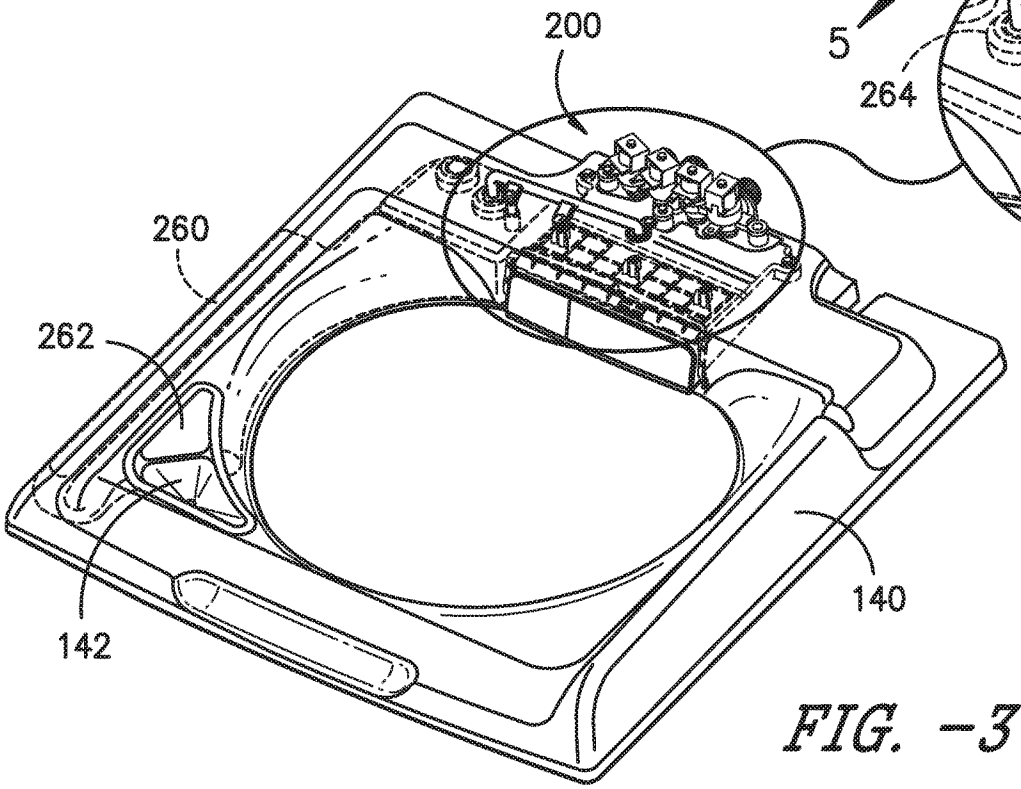
FIG. 3 provides a perspective view of the top panel of the exemplary washing machine appliance of FIG. 1.

Top panel 140 also defines a hole or opening 142, e.g., at a corner of top panel 140 at or adjacent a front portion of top panel 140 as shown in FIG. 2. Opening 142 is configured for receipt of one of a plurality of fluid additives, e.g., detergent, fabric softener, and/or bleach. Opening 142 permits the fluid additive to pass through top panel 140 to a reservoir 260 (e.g., shown in FIG. 3) positioned below top panel 140 along the vertical direction V. Thus, a user may pour the fluid additive into reservoir 260 through opening 142 in top panel 140. Reservoir 260 is described in greater detail below in conjunction with dispensing assembly 200 (e.g., shown in FIG. 3).

A control panel 110 with at least one input selector 112 extends from top panel 140, e.g., at a rear portion of cabinet 102 opposite opening 142 about aperture 105 along the transverse direction T. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through aperture 105, and washing operation is initiated through operator manipulation of input selectors 112. Wash basket 120 is filled with water and detergent and/or other fluid additives via dispenser box assembly 200, which will be described in detail below. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through aperture 105.

Referring now generally to FIGS. 3 through 7, an exemplary dispensing assembly 200 is described in more detail. Although described below in the context of washing machine appliance 100, it will be understood that dispensing assembly 200 may be used in or with any other suitable washing machine appliance, in alternative exemplary embodiments. In addition, other configurations of dispensing assembly 200 may be provided as well. For example, dispensing assembly 200 may have a different shape or configuration, and may dispense water, detergent, or other additives. Other variations and modifications of the exemplary embodiment described below are possible, and such variations are contemplated as within the scope of the present subject matter.

Dispensing assembly 200 draws fluid additive, e.g., detergent, fabric softener or other additives, from reservoir 260 for dispersal into wash basket 120. Reservoir 260 includes an inlet 262 in fluid communication with opening 142 for receipt of fluid additives via opening 142. In exemplary embodiments, inlet 262 may be positioned at, e.g., directly below, opening 142. Reservoir 260 also includes an outlet 264 and an additive storage volume 266 (e.g., shown in FIG. 5) positioned between the inlet 262 and the outlet 264. Additive storage volume 266 is bounded in the vertical direction V by a bottom wall 268 of the reservoir 260 and a top wall 270 of the reservoir 260. Thus, a maximum additive height, i.e., the highest point of the fluid storage volume 266 of the reservoir 260 is defined by top wall 270 of reservoir 260. In the exemplary embodiment illustrated herein, dispensing assembly 200 is mounted to the top panel 140. One skilled in the art will appreciate that dispensing assembly 200 may be mounted in other locations in alternative exemplary embodiments. The dispensing assembly 200 includes a supply conduit 280 and an aspirator 300. As used herein, terms such as aspirator, Venturi pump, eductor, and jet pump are generally interchangeable.

Figure 5:
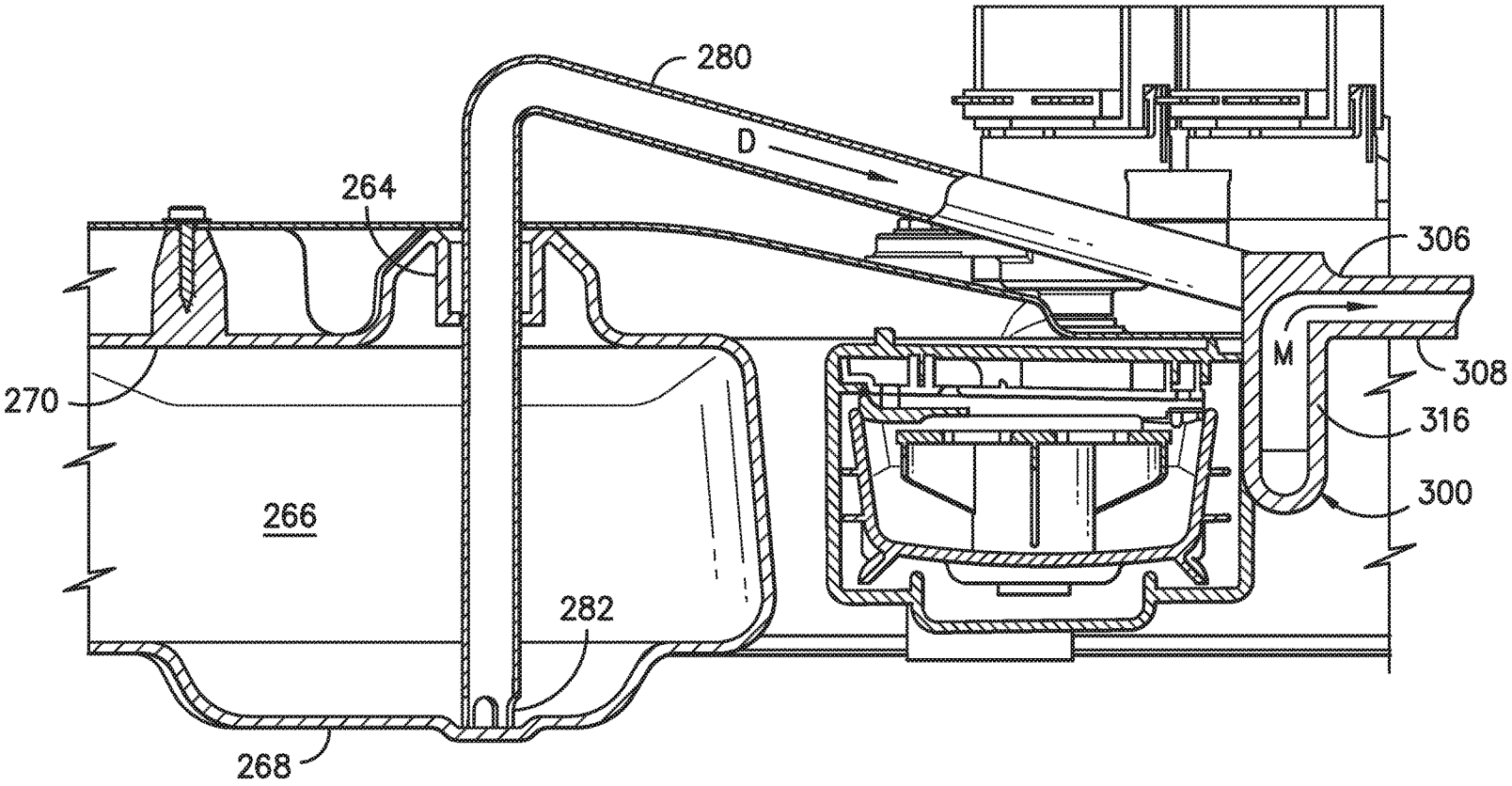
FIG. 5 provides a partial section view taken along line 5-5 in FIG. 4 of a bulk dispense system according to an exemplary embodiment of the present subject matter.

In exemplary embodiments, e.g., as illustrated in FIG. 5, the supply conduit 280 extends between the reservoir 260 and the aspirator 300 for drawing fluid additive(s) stored within additive storage volume 266 from reservoir 260. Supply conduit 280 may be coupled to reservoir outlet 264, e.g., as illustrated in FIG. 5, supply conduit 280 is coupled to reservoir outlet 264 such that supply conduit 280 extends through outlet 264 into additive storage volume 266 and supply conduit 280 terminates in an open inlet end 282 at or near bottom wall 268 of reservoir 260.

Figure 6:
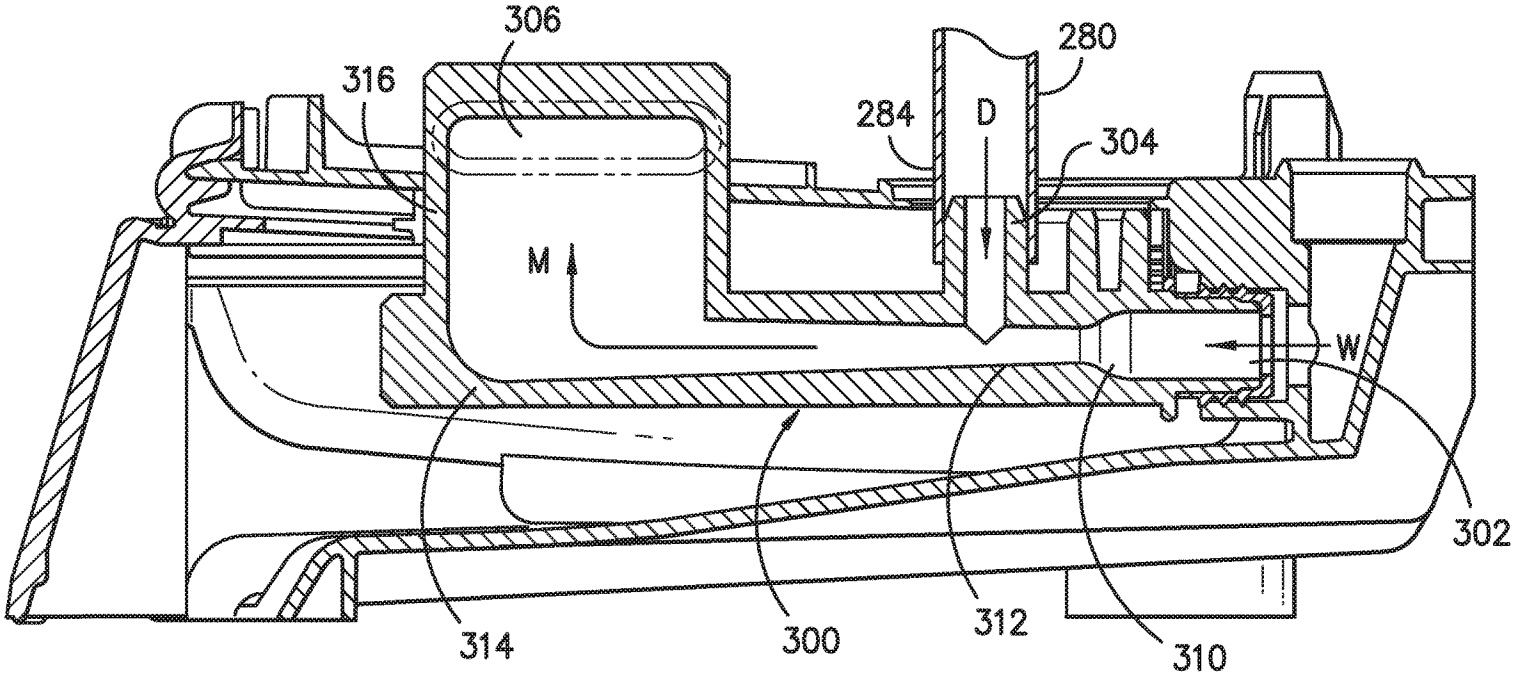
FIG. 6 provides a longitudinal section view of a bulk dispense system including an aspirator according to an exemplary embodiment of the present subject matter.
Figure 7:
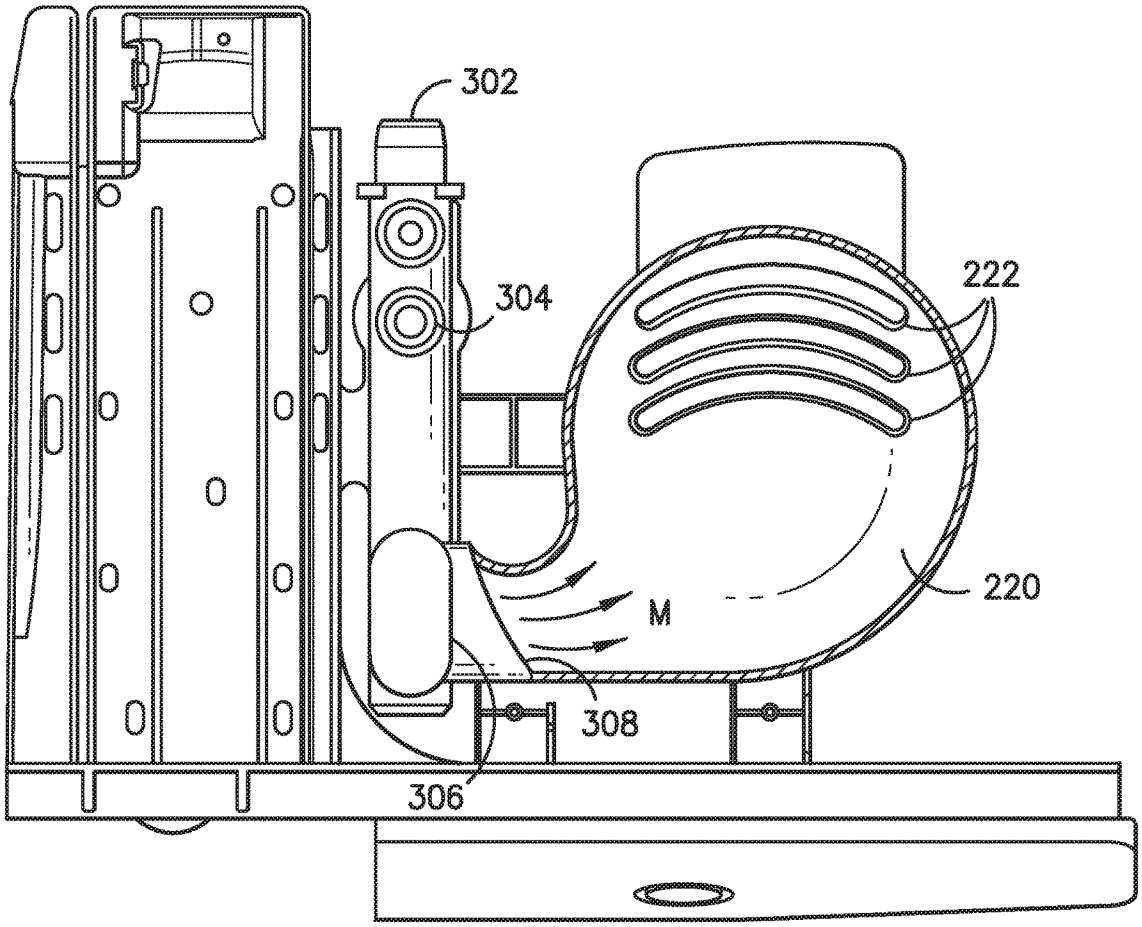
FIG. 7 provides a partial plan view of a bulk dispense system including an aspirator according to an exemplary embodiment of the present subject matter.
Figure 8:
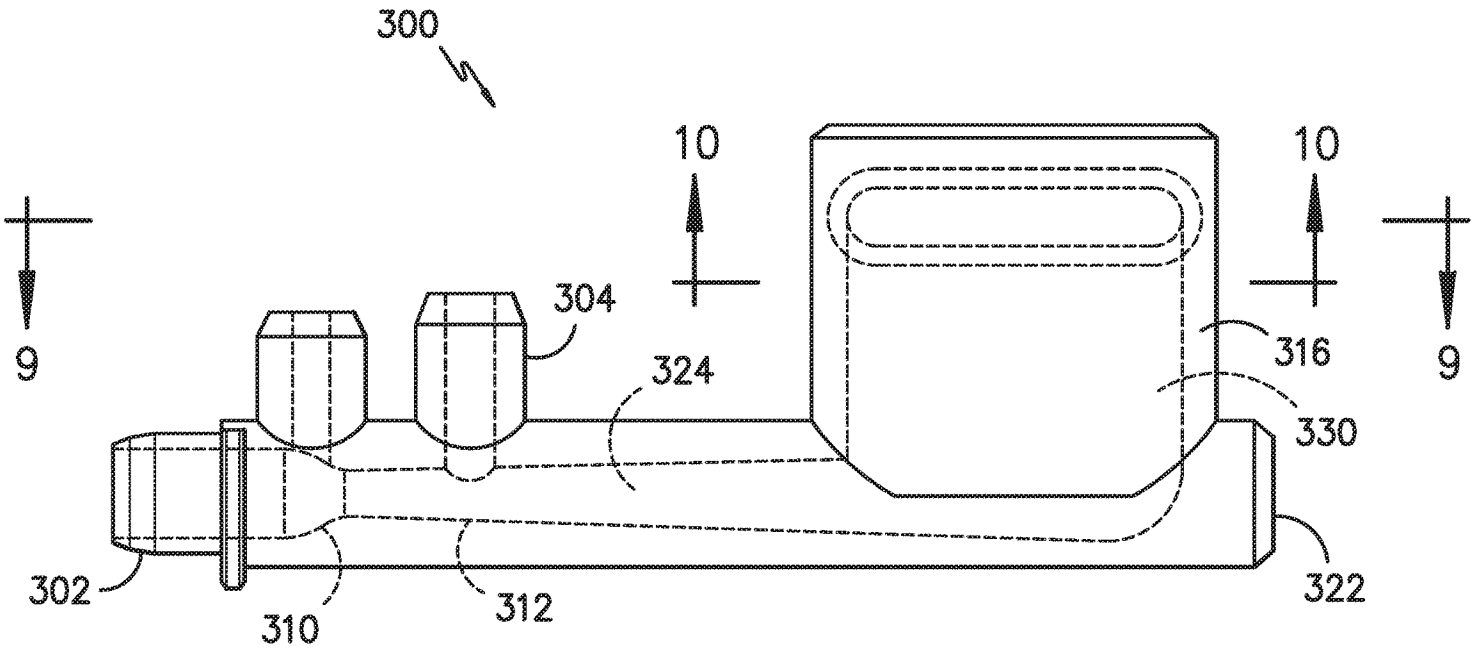
FIG. 8 provides an elevation view of an aspirator according to an exemplary embodiment of the present subject matter.
Figure 9:
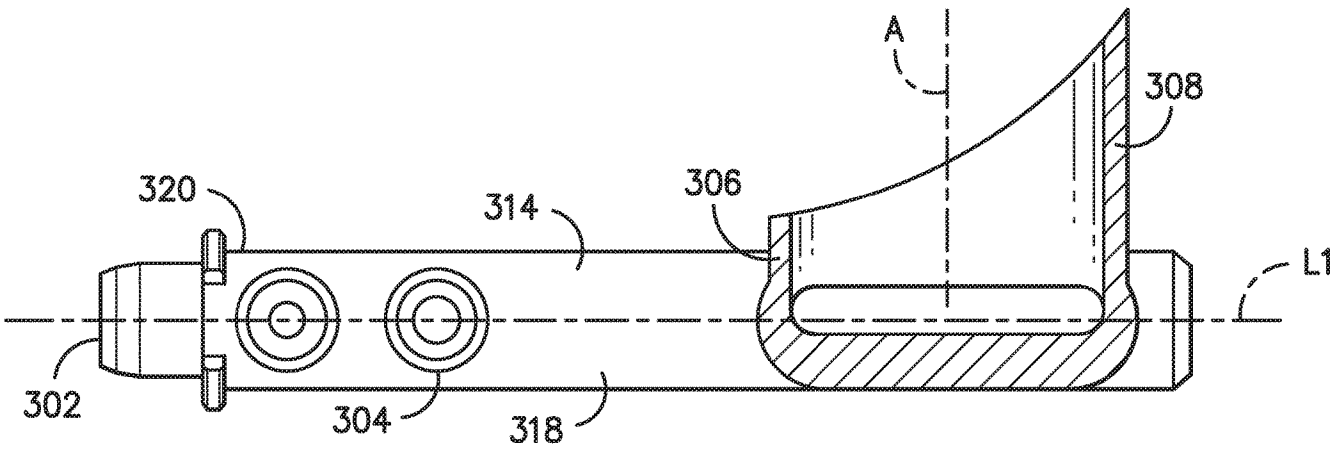
FIG. 9 provides a section view taken along line 9-9 in FIG. 8 of the exemplary aspirator.
Figure 10:
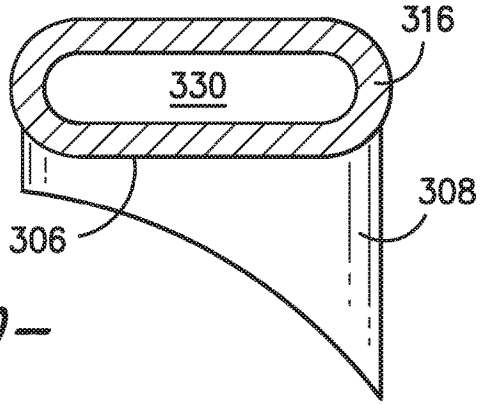
FIG. 10 provides a section view taken along line 10-10 in FIG. 8 of the exemplary aspirator.
Figure 11:
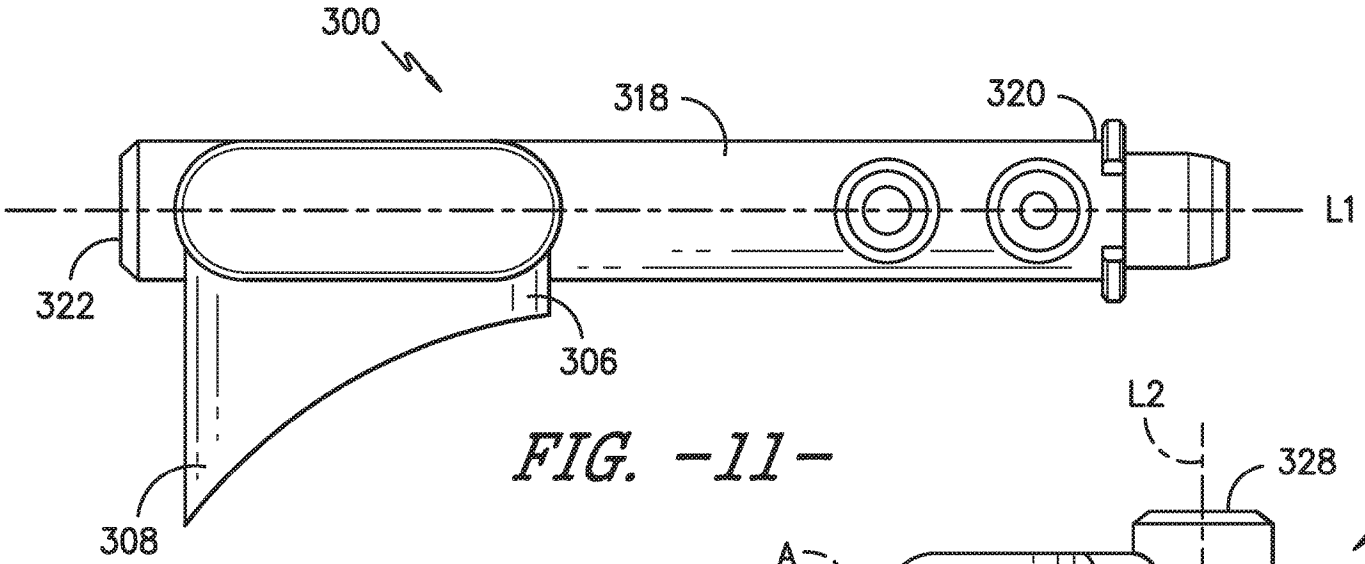
FIG. 11 provides a plan view of the exemplary aspirator.

In exemplary embodiments, e.g., as shown in FIGS. 6 and 7, the aspirator 300 has a water inlet conduit 302, an additive inlet conduit 304, and an outlet conduit 306. Water inlet conduit 302 is in fluid communication with a water source (not shown), e.g., using a hose or other conduit. Additive inlet conduit 304 is coupled to an outlet end 284 of supply conduit 280. Returning again to the exemplary illustration of FIG. 5, it can be seen that the outlet conduit 306 of the aspirator 300 is positioned above the fluid storage volume 266 of the reservoir 260. More particularly, the lowest point of the outlet conduit 306 of the aspirator 300 is positioned above the top wall 270, i.e., the highest point of the fluid storage volume 266, of the reservoir 260. Thus, gravity induced flow or siphoning of fluid from reservoir 260 to outlet 308 may be avoided or minimized. As such, when the motive flow (as described in more detail below) through aspirator 300 is stopped, without gravitational head to maintain the flow, flow of fluid from reservoir 260 to aspirator 300 will stop.

As may be seen e.g., in FIGS. 5 and 6, the aspirator 300 is coupled to the supply conduit 208 such that the aspirator 300 draws fluid additive from the reservoir 260 through the supply conduit 280 when a motive fluid, e.g., water, flows through the aspirator 300. In the exemplary embodiment illustrated in FIG. 6, water flows from water inlet conduit 302 through converging section 310 and diverging section 312 to outlet 306. Converging section 310 of aspirator 300 is disposed upstream of diverging section 312 of aspirator 300 relative to the flow of water W through aspirator 300. As the flow of water W enters converging section 310 of aspirator 300, the flow of water W may increase in velocity and decrease in pressure. Conversely, as the flow of water W passes from converging section 310 of aspirator 300 into diverging section 312 of aspirator 300, the flow of water W may increase in pressure and decrease in velocity.

The change in pressure of the flow of water W through aspirator 300 may assist with drawing an additive, e.g., detergent, from reservoir 260. For example, storage volume 266 of reservoir 260 may be exposed to or contiguous with ambient air about washing machine appliance 100 (e.g., via inlet 262 of reservoir 260), and outlet end 284 of supply conduit 280 may be positioned on aspirator 300 (e.g., converging section 310 of aspirator 300 or diverging section 312 of aspirator 300) such that a pressure of fluid at outlet end 284 of supply conduit 280 is less than the pressure of detergent within reservoir 260 at inlet end 282 of supply conduit 280. In exemplary embodiments, e.g., as illustrated in FIG. 6, converging section 310 is downstream of the water inlet conduit 302, diverging section 312 is downstream of the converging section 310, and the additive inlet conduit 304 opens into the diverging section 312. Thus, aspirator 300 may pump additive, e.g., detergent D, from reservoir 260 to aspirator 300 via supply conduit 280 when the flow of water W passes through aspirator 300. Within aspirator 300, the flow of water W and the flow of detergent D mix and a mixture of water and detergent M exits aspirator 300 and flows into wash basket 120. In such a manner, detergent from reservoir 260 may be dispensed into wash basket 120.

Outlet conduit 306 may have a large opening, i.e., a large cross-sectional area, to provide a high flow rate. In exemplary embodiments, e.g., as illustrated in FIG. 6, outlet conduit 306 may have a generally oblong elongate cross-sectional shape. In other exemplary embodiments, outlet conduit may have other shapes, e.g., may be more symmetrical, or even circular, so long as sufficient area is provided for the desired high flow.

In exemplary embodiments, e.g., as illustrated in FIG. 7, mixed flow M exits aspirator 300 at outlet conduit 306, and aspirator 300 may further include a projection 308 extending from the outlet conduit 306. The projection 308 may assist directing mixed flow M into a shower plate 220. Shower plate 220 may be disposed above wash basket 120 for distributing mixed flow M into wash basket 120 via vents 222 of the shower plate 220. Projection 308 may also direct mixed flow M generally towards water inlet conduit 302 of aspirator 300.

Referring now generally to FIGS. 8 through 14, an exemplary aspirator 300 will be described in more detail. The aspirator 300 comprises a first conduit 314 and a second conduit 316. The first conduit 314 defines a longitudinal axis L1 (see, e.g., FIG. 9). A longitudinal axis L2 (see, e.g., FIG. 12) of the second conduit 316 is angled generally orthogonal to the longitudinal axis L1 of the first conduit 314. As used herein, the term "generally" means about, e.g., with respect to an angle, within ten degrees (10°) of the stated angle. Thus, for example, generally orthogonal encompasses a range of angles from about eighty degrees (80°) to about one hundred and ten degrees (110°). The first conduit 314 comprises a cylindrical body 318 with the water inlet conduit 302 of the aspirator 300 at a first end 320 of the cylindrical body 318, a longitudinal cavity 324 in fluid communication with the water inlet conduit 302, and a closed second end 322 of the cylindrical body 318 opposing the first end 320 of the cylindrical body 318.

Figure 12:
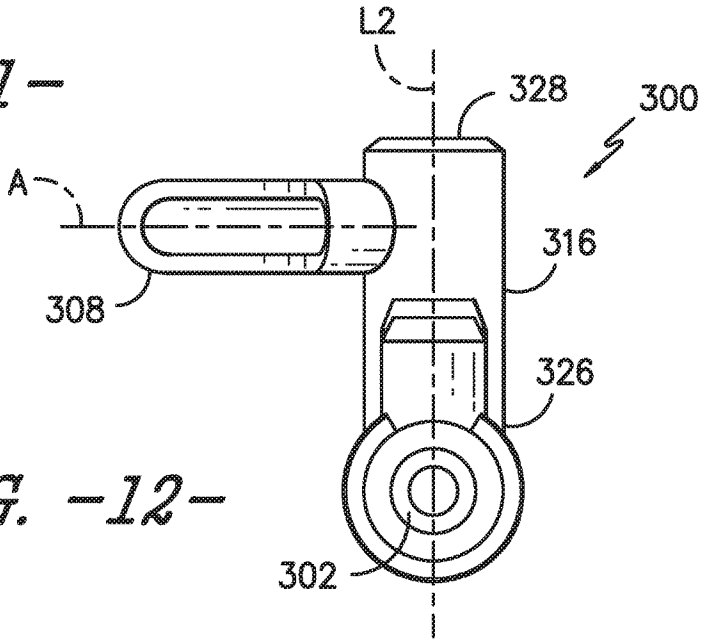
FIG. 12 provides a side elevation view of the exemplary aspirator.
Figure 13:
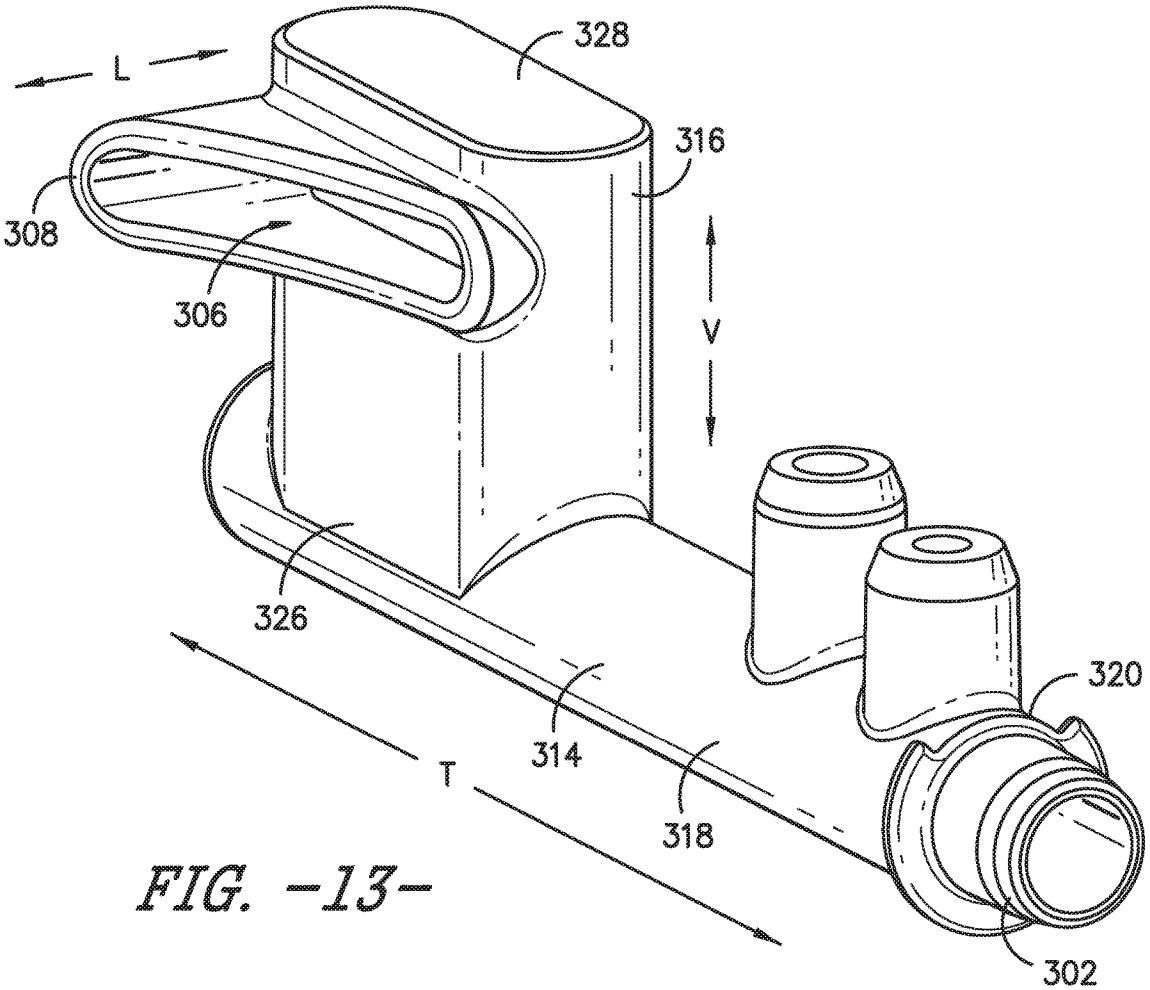
FIG. 13 provides a perspective view of the exemplary aspirator.
Figure 14:
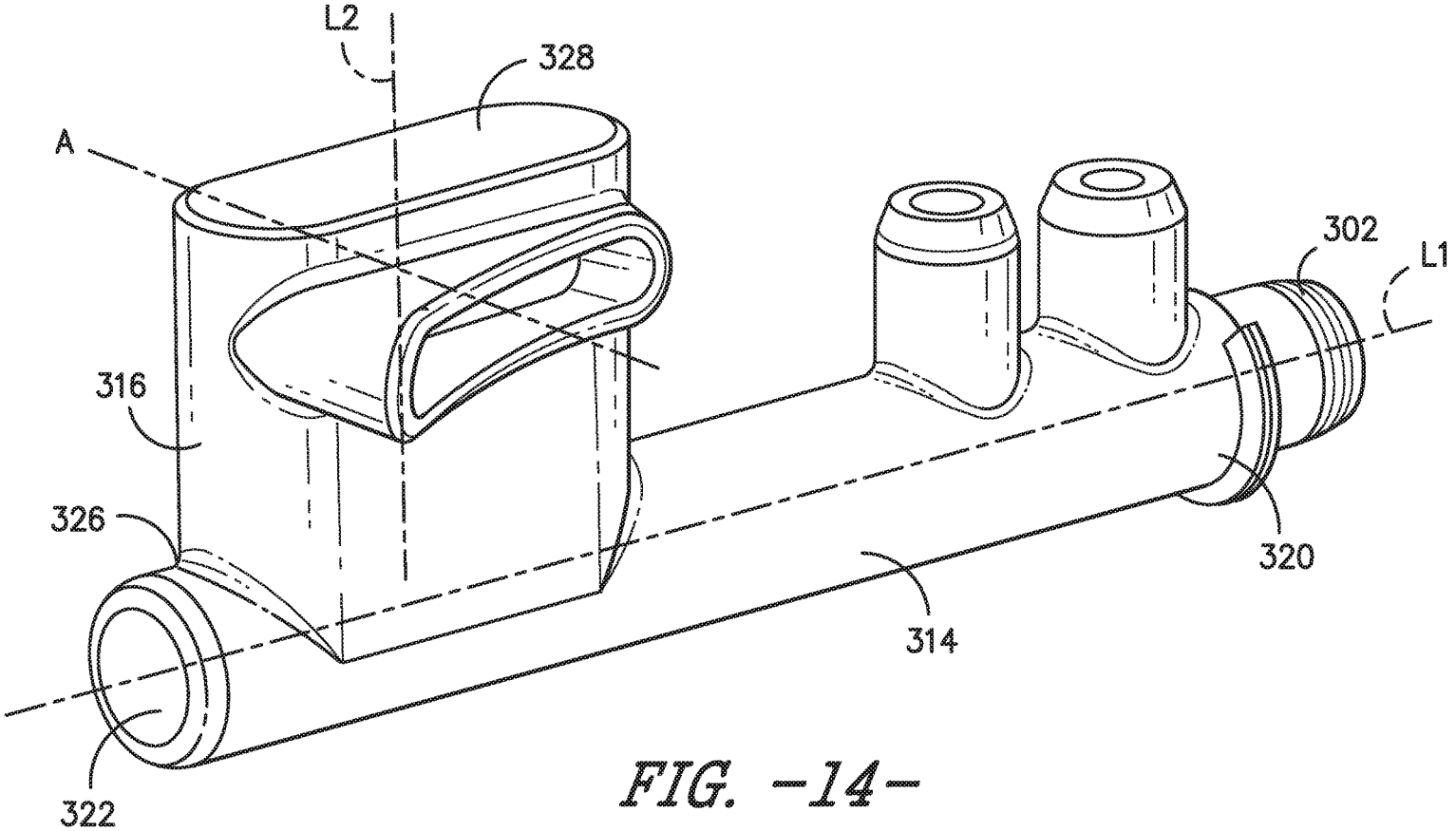
FIG. 14 provides a perspective view of the exemplary aspirator.

As may be seen, e.g., in FIG. 12, the second conduit 316 extends between a first end 326 and a second end 328. The first end 326 of the second conduit 316 is disposed proximate to the second end 322 of the first conduit 314 (see, e.g., FIG. 11) and the outlet conduit 306 of the aspirator 300 is disposed on the second end 328 of the second conduit 316. As illustrated for example in FIGS. 6, 8, and 10, the second conduit 316 comprises a longitudinal cavity 330 in fluid communication with the longitudinal cavity 324 of the first conduit. Also, the longitudinal cavity 330 of second conduit 316 is generally orthogonal to the longitudinal cavity 324 of the first conduit 314. Further, as may be seen, e.g., in FIG. 5, the longitudinal cavity 330 of second conduit 316 is in fluid communication with the outlet conduit 306.

In exemplary embodiments, the aspirator 300 may include two ninety-degree (90°) turns in the flow path of mixed flow M. As may be seen, e.g., in FIGS. 9, 12, and 14, a central axis A of the outlet conduit 306 is generally orthogonal to the longitudinal cavity 324 of the first conduit 314 and generally orthogonal to the longitudinal cavity 330 of the second conduit 316. As may be seen, e.g., in FIGS. 13 and 14, the longitudinal axis L1 of the first conduit 314 is oriented along the transverse direction T, the longitudinal axis L2 of the second conduit 316 is oriented along the vertical direction V, and the central axis A of the outlet conduit 306 is oriented in the lateral direction L. As a result of this configuration, mixed flow M makes a first ninety-degree (90°) turn as it flows from longitudinal cavity 324 of first conduit 314 to longitudinal cavity 330 of second conduit 316 (see, e.g., FIG. 6) and makes a second ninety-degree (90°) turn as it flows from longitudinal cavity 330 of second conduit 316 to outlet conduit 306 (see, e.g., FIG. 5).

As described above, the positioning of outlet 306 of aspirator 300 above the maximum fill level of reservoir 260 reduces or eliminates gravitational head such that when flow of motive fluid is stopped, flow of additive will stop. Further, providing the aspirator 300 with an offset outlet conduit 306 relative to inlet conduit 302 permits aspirator 300 to so function even when the location of water inlet conduit 302 is constrained and/or available space for the aspirator 300 is minimal.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

what is claimed is:

1. A washing machine appliance defining a vertical direction, a lateral direction and a transverse direction that are mutually perpendicular to one another, the washing machine appliance comprising:

a cabinet having a top panel, the top panel defining an opening configured for receipt of an additive;

a basket rotatably mounted within the cabinet below the top panel along the vertical direction;

a reservoir positioned below the top panel along the vertical direction, the reservoir comprising an inlet, an outlet, and an additive storage volume, the additive storage volume positioned between the inlet and the outlet of the reservoir, the inlet of the reservoir positioned at the opening of the top panel; and a dispensing assembly mounted to the top panel, the dispensing assembly comprising a supply conduit and an aspirator, the supply conduit extending between the reservoir and the aspirator, the aspirator comprising;

a first conduit comprising a cylindrical body extending along the transverse direction between a first end and a second end;

a water inlet conduit positioned at the first end of the cylindrical body of the first conduit;

a second conduit extending along the vertical direction between a first end of the second conduit and a second end of the second conduit, the first end of the second conduit disposed proximate to the second end of the first conduit;

an additive inlet conduit; and an outlet conduit defining a central axis oriented along the lateral direction, the outlet conduit of the aspirator positioned at the second end of the second conduit above the additive storage volume of the reservoir along the vertical direction;

wherein the second conduit is in fluid communication with the first conduit and in fluid communication with the outlet conduit.

2. The washing machine appliance of claim 1, wherein a lowest point of the outlet conduit of the aspirator is positioned above a highest point of the fluid storage volume of the reservoir along the vertical direction.

3. The washing machine appliance of claim 1, wherein the aspirator is coupled to the supply conduit such that the aspirator draws fluid additive from the reservoir through the supply conduit when a motive fluid flows through the aspirator.

4. The washing machine appliance of claim 1, wherein the first conduit defines a longitudinal axis, a longitudinal axis of the second conduit angled generally orthogonal to the longitudinal axis of the first conduit.

5. The washing machine appliance of claim 4, wherein the first conduit comprises a longitudinal cavity in fluid communication with the water inlet conduit, and the second end of the cylindrical body of the first conduit comprises a closed second end opposing the first end of the cylindrical body.

6. The washing machine appliance of claim 5, wherein the second conduit comprises a longitudinal cavity in fluid communication with the longitudinal cavity of the first conduit, generally orthogonal to the longitudinal cavity of the first conduit, and in fluid communication with the outlet conduit.

7. The washing machine appliance of claim 5, wherein the longitudinal cavity of the first conduit includes a converging section downstream of the water inlet, a diverging section downstream of the converging section, and wherein the additive inlet conduit opens into the diverging section.

8. The washing machine appliance of claim 1, wherein the aspirator further comprises a projection extending from the outlet conduit.

9. An aspirator for a washing machine appliance, the aspirator defining a first direction, a second direction and a third direction that are mutually perpendicular to one another, the aspirator comprising:

a first conduit comprising a cylindrical body extending along the first direction between a first end and a second end;

a water inlet conduit positioned at the first end of the cylindrical body of the first conduit;

a second conduit extending along the second direction between a first end of the second conduit and a second end of the second conduit, the first end of the second conduit disposed proximate to the second end of the first conduit;

an additive inlet conduit; and an outlet conduit defining a central axis oriented along the third direction, the outlet conduit of the aspirator positioned at the second end of the second conduit, the outlet conduit generally orthogonal to the water inlet conduit in a plane defined by the first and third directions, and the outlet conduit offset from the water inlet conduit along the second direction;

wherein the second conduit is in fluid communication with the first conduit and in fluid communication with the outlet conduit.

10. The aspirator of claim 9, wherein the outlet conduit is positioned above the water inlet conduit along the second direction.

11. The aspirator of claim 9, wherein the water inlet is positioned at a first end of the cylindrical body of the first conduit, and wherein the first conduit comprises a longitudinal cavity in fluid communication with the water inlet conduit and a closed second end of the cylindrical body opposing the first end.

12. The aspirator of claim 11, wherein the second conduit comprises a longitudinal cavity in fluid communication with the longitudinal cavity of the first conduit, the longitudinal cavity of the second conduit generally orthogonal to the longitudinal cavity of the first conduit, and the longitudinal cavity of the second conduit in fluid communication with the outlet conduit.

13. The aspirator of claim 11, wherein the longitudinal cavity of the first conduit includes a converging section downstream of the water inlet, a diverging section downstream of the converging section, and wherein the additive inlet conduit opens into the diverging section.

* * * * *